United States Patent [19]

Bayle-Laboure et al.

[11] 4,455,822

[45] Jun. 26, 1984

[54] DEVICE TO IGNITE FUEL INJECTED IN A RAPIDLY FLOWING GASEOUS MEDIUM

[75] Inventors: Gérard J. P. Bayle-Laboure, Paris; Mark F. B. Buisson, Le Mee sur Seine; Roger B. Linstrumelle, Dammarie les Lys; Jean-Claude Pachot, Champigny sur Yonne, all of France

[73] Assignee: Societe Nationale d'Etude et de Construction de Moteurs d'Aviation, France

[21] Appl. No.: 347,588

[22] Filed: Feb. 10, 1982

[30] Foreign Application Priority Data

Feb. 17, 1981 [FR] France ..... 81 03046

[51] Int. Cl.[3] ..... F02C 7/26; F02G 1/00

[52] U.S. Cl. ..... 60/39.822; 60/39.826; 60/39.827; 60/723

[58] Field of Search ..... 60/39.822, 39.826, 39.827, 60/723, 261

[56] References Cited

U.S. PATENT DOCUMENTS

| | | | |
|---|---|---|---|
| 4,033,133 | 7/1977 | Houseman et al. | 60/606 |
| 4,118,171 | 10/1978 | Flanagan et al. | 60/723 |
| 4,125,998 | 11/1978 | Barou et al. | 60/261 |

*Primary Examiner*—Louis J. Casaregola
*Assistant Examiner*—Timothy S. Thorpe
*Attorney, Agent, or Firm*—Bacon & Thomas

[57] ABSTRACT

An open ended enclosure has a tubular conduit extending axially within it and is provided with both an electric spark plug and a catalytic ignition member in the annular region of the enclosure outside the tubular conduit.

3 Claims, 3 Drawing Figures

DEVICE TO IGNITE FUEL INJECTED IN A RAPIDLY FLOWING GASEOUS MEDIUM

BACKGROUND OF THE INVENTION

The invention concerns a device to ignite fuel injected in a rapidly flowing gaseous fuel medium, to be used particularly to ignite the afterburner of an aircraft turbojet engine.

U.S. Pat. No. 4,125,998 discloses an ignition device comprising an enclosure placed in a gaseous flow path and equipped with an ignition element such as a spark plug. This known device is characterized by the feature that said enclosure receives, through an inlet grill or perforated plate, a fuel mixture which is ignited in said enclosure by said device, and that it is provided with a tubular conduit receiving through its upstream end a jet of fuel which it discharges, with the gases taken by said upstream end from said flow, in said enclosure downstream from said ignition device.

After the afterburner has been ignited, the ignition element, such as a spark plug, is no longer operated, so that the enclosure of the ignition device is not constantly ignited.

SUMMARY OF THE INVENTION

The present invention concerns an improvement in the ignition device described hereinabove, the object of the present improvement being to perfect the operation of the ignition device, especially at elevated temperatures.

The device to ignite fuel injected in a rapidly flowing gaseous fuel medium is of the aforementioned type and is characterized in that the enclosure, equipped with an ignition element such as an electric spark plug, further comprises a catalytic ignition element placed in said enclosure upstream from the downstream end of the tubular conduit intended to discharge a jet of fuel, and on the outside of, for example, around said tubular conduit.

The additional catalytic ignition element provided according to the present invention, offers a double advantage; on the one hand; as the catalytic ignition element acts only on gases already heated to a high temperature, of the order of 350° C., it supplements the ignition element, such as an electric spark plug, in the operating range of the turbojet engine corresponding to elevated gas temperatures, so as to increase the reliability of the ignition device in this operating range. On the other hand, since the catalytic ignition element is capable of operating in a constant manner without the consumption of energy, it makes it possible to use the ignition device according to the present invention to produce a pilot flame.

It is already known to use catalytic ignition devices in the art of turbojet engines.

French Pat. No. 1,454,312 describes a device to ignite fuel injected in the flow of fuel gases, comprising at least one catalytic element located in a circulating passage inside a mass of refractory material. It is further indicated that catalytic element or elements may be used in the ejection tube of a turbojet engine. The result is, however, that such an ignition device, lacking an ignition device such as an electric spark plug, functions poorly at low temperatures of the gases ejected.

On the other hand, the ignition device with a purely catalytic action described in the above-cited patent must be supplied with a flow of air under pressure, taken from the outlet of the compressors of the turbojet engine; some of the disclosed embodiments further require a special fuel supply. Compared to these embodiments of the prior art, the ignition device according to the present invention offers the additional advantage of not requiring a special supply of compressed air, since, as indicated in U.S. Pat. No. 4,125,998, the ignition device according to the present invention is supplied directly by the hot gases of the turbine passing through the afterburner conduit and the jet of fuel provided by the bank of injectors mounted in said afterburner conduit.

French Pat. No. 2,382,584 describes a gas turbine, in the combustion chamber whereof there are placed in series, a pilot burner supplied by a fuel injector and associated with a conventional electric ignition device, and a catalytic combustion zone, placed downstream from the combustion chamber. In fact, in the case of the device described in this patent of the prior art, the conventional ignition device and the catalytic element do not act on the same mass of gases and they are not located visibly in the same ignition device to be used in the afterburner of a turbojet engine.

U.S. Pat. No. 4,040,252 describes a combustion chamber comprising an axial premixing section, into which the fuel is injected, the flow of hot gases being guided subsequently to a peripheral section of annular configuration, containing the catalytic elements. In this case again, the means used to ignite the fuel do not act on the same mass of gas passing through the catalytic elements. Also, it is not an ignition device for the afterburner.

The ignition device of the present invention is capable of two principal forms of embodiment, differing from each other in that the catalytic ignition element is located in the enclosure in a first embodiment, downstream from the part of the ignition device, such as a spark plug penetrating said enclosure, and, in the other embodiment, at the level and preferably facing, the part of the ignition device such as a spark plug, penetrating the said enclosure. In relation to the action of the ignition device such as a spark plug, on the gaseous flow passing through the enclosure, the action of the catalytic ignition element takes place in series in the first embodiment, and in parallel in the second embodiment.

BRIEF DESCRIPTION OF THE DRAWINGS

As examples, two embodiments are described hereinbelow and illustrated schematically in the drawings.

DESCRIPTION OF THE PREFERRED EMBODIMENTS

Figure 1:
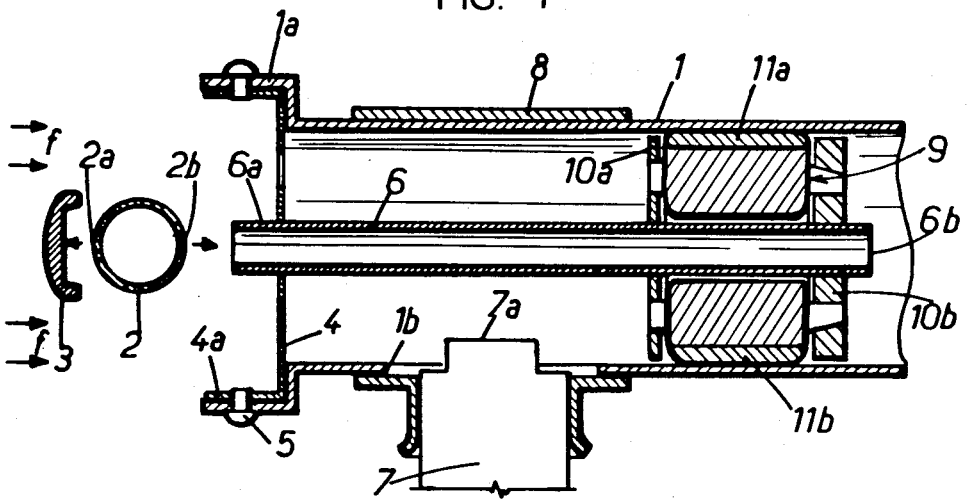
FIG. 1 is a view in axial section of the first embodiment.
Figure 2:
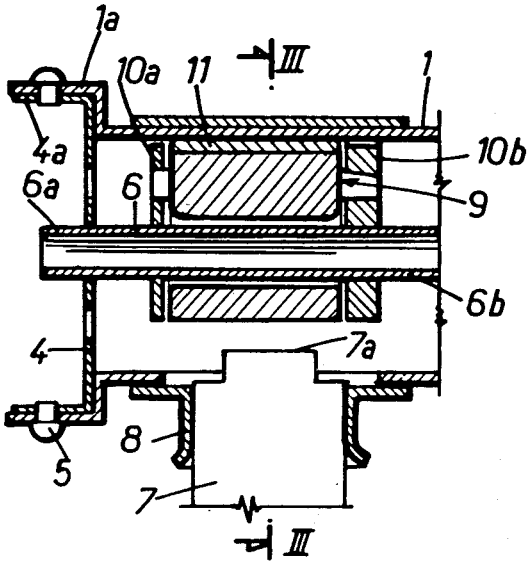
FIG. 2 is a view in axial section of the second embodiment.

FIG. 1 shows an axial section through an ignition device according to the present invention, mounted in particular in the afterburner tube of an aircraft turbojet engine, such as the ignition device 11 shown in FIGS. 1 and 2 of U.S. Pat. No. 4,125,998.

In FIG. 1, the reference numeral 1 designates a sheath of a generally tubular configuration, open at both ends; the tubular sheath 1 has a constant diameter over the greater part of its length and a somewhat larger diameter in its upstream part 1*a*, which is placed with respect to the injector bank and the anvil 3 as described in U.S. Pat. No. 4,125,998,. In the upstream end 1*a* of the tubular sheath 1 a grill is placed fixedly; it is attached by its collar 4*a* to the wall of said upstream part 1*a*, by appropriate means, for example, rivets 5. The perforations of the grill 4 are dimensioned so as to gauge the flow of the gaseous mixture penetrating the inside of the tubular sheath 1 in the direction of the arrows f. As described in the U.S. Pat. No. 4,125,998, a tubular conduit 6, metal, for example, is placed inside the tubular sheath 1, coaxially with it, while the upstream end 6*a* of the tubular conduit 6 passes through a center hole of the grill 4, which serves as its support. An ignition element, such as an electric spark plug 7 is attached at its end 7*a* to the inside of the sheath 1, through an orifice 1*b* provided in the median part of its lateral wall. The tightness of the sheath 1 at the spark plug 7 is ensured by a sleeve 8.

According to the present invention, a catalytic ignition element, the entirety whereof is designated by 9, is placed in the tubular enclosure 1, upstream from the downstream end 6*b* of the tubular conduit 6 and around said tubular conduit 6. In this first embodiment, the catalytic ignition element 9 is further placed in the enclosure 1, downstream from the part 7*a* of the spark plug 7 which penetrates into the enclosure 1, said catalytic element 9 being located between two transverse grills 10*a* and 10*b*, consisting of or being clad by a refractory material; in the embodiment under consideration, this refractory sheath consists of two half shells, 11*a* and 11*b*, inserted between the two grills 10*a* and 10*b*. The catalytic element 9 itself consists, for example, of a metal mesh or sponge, particularly platinum sponge. Finally, the inner wall of the enclosure 1 and the outer wall of the tubular conduit 6 are also clad with a refractory material, entirely or at least on their parts located between the two grills 10*a* and 10*b*. The assembly of 9-10*a*-10*b*-11*a*-11*b* is preferably inserted with a slight friction fit in the annular space between the tubular sheath 1 and the tubular conduit 6, in a manner so that it may be extracted easily from said annular space through the open downstream end of the tubular enclosure 1, so as to facilitate the replacement of the catalytic ignition element 9, when its operation becomes unsatisfactory. Locking means (not shown) are advantageously provided, for example, a circlip upstream from the grill 10*a* and a circlip downstream from the grill 10*b*, insertable in grooves provided for this purpose in the tubular sheath 1.

The ignition device illustrated in FIG. 1 and described hereinabove operates in the following manner: the injector manifold 2 projects, through its upstream jets 2*a*, fuel, which is atomized on the anvil 3; the fuel atomized in this manner is transported by the flow of hot gases coming from the turbine (not shown) in the direction indicated by the arrows f, with the gaseous mixture penetrating into the annular enclosure 1 through the perforations of the grill 4. Simultaneously, the downstream jet 2*b* of the injection manifold 2 projects fuel into the tubular conduit 6, as described in the U.S. Pat. No. 4,125,998. During the startup period of the turbojet engine, the electric spark plug 7 is supplied with electricity and it effects efficiently the ignition of the gaseous mixture present in the annular space between the tubular enclosure 1 and the tubular conduit 6; the gaseous combustion mixture passes through the grill 10*a*, the catalytic element 9 and the grill 10*b*, then leaves the enclosure 1 through its open downstream end, where the gaseous mixture ignites the fuel coming from the downstream end of the tubular conduit 6*b*, as described in the U.S. Pat. No. 4,125,998. During this startup phase, the catalytic action of the catalytic element 9 is practically negligible because of its low temperature; however, this temperature rises progressively through heat exchange with the gaseous combustion mixture passing through it.

When the catalytic element 9 attains a temperature of the order of 350° C., said catalytic element functions as an ignition element so well that the electric spark plug 7 may be deactivated.

Figure 3:
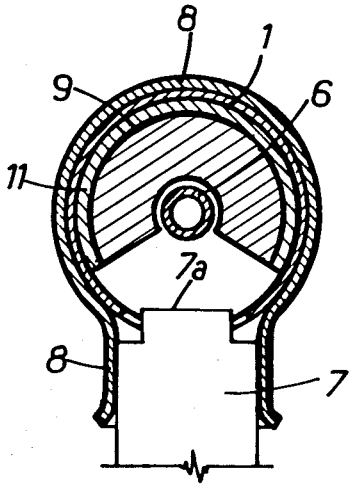
FIG. 3 is a cross section taken on the line III—III of FIG. 2.

In FIGS. 2 and 3, which show a second embodiment, the same references are used to designate elements similar to those of the embodiment of FIG. 1. This second embodiment differs from that shown in FIG. 1 only in that the catalytic ignition element 9 is placed in the enclosure 1 facing the part 7*a* of the electric spark plug 7 which penetrates into the enclosure 1. Consequently, when the electric spark plug 7 is active and the catalytic element 9 is heated to an adequate temperature, the two ignition elements act in parallel on the gaseous mixture passing through the annular space between the enclosure 1 and the conduit 6, while under the same conditions, they would act in series on the gaseous mixture in the case of the embodiment of FIG. 1.

The present invention is not limited to the aforedescribed embodiments. It includes all of their variants.

What is claimed is:

1. In a device for igniting fuel injected into a high temperature rapidly flowing gaseous fuel medium such as in an afterburner of an aircraft turbojet engine wherein the device has a tubular sheath located in the rapidly flowing gaseous medium, a tubular conduit disposed coaxially within the tubular sheath defining an annular flowpath therebetween, fuel injection means to mix atomized fuel with the high temperature gases, and direct the mixture into and through the annular flowpath and to direct fuel into and through the tubular conduit, and an electric spark device extending through the tubular sheath at a predetermined location along the annular flowpath to ignite the fuel/air mixture therein, the improvement comprising (a) a catalytic ingition element having an arcuate cross-sectional shape; and, (b) an insulating and retaining layer attached to the outer periphery of the arcuate-shaped catalytic ignition element, the layer dimensioned to frictionally engage the interior of the tubular sheath so as to retain the catalytic ignition element disposed partially about the tubular sheath in the same location along the flowpath as the electric spark device wherein the catalytic ignition element is heated to its activation temperature by contact with the high temperature gases flowing through the annular flowpath such that it may operate independently of the electric spark device to ignite the mixture flowing through the annular flowpath which, upon exiting the tubular sheath, ignites the fuel exiting the tubular conduit.

2. A device as defined in claim 1 wherein said catalytic ignition element is located between two transverse grilles in said tubular sheath and wherein the insulating and retaining layer is a refractory material.

3. A device as defined in claim 2 wherein at least the portion of an inner wall of said tubular sheath and an outer wall of said tubular conduit between said two grilles are also clad with a refractory material.

* * * * *

UNITED STATES PATENT AND TRADEMARK OFFICE

CERTIFICATE OF CORRECTION

PATENT NO. : 4,455,822

DATED : June 26, 1984

INVENTOR(S) : BAYLE-LABOURE ET AL.

It is certified that error appears in the above-identified patent and that said Letters Patent is hereby corrected as shown below:

Column 3, line 51, "injector" should read --injection--.

Signed and Sealed this

*Nineteenth* Day of *March 1985*

[SEAL]

*Attest:*

DONALD J. QUIGG

*Attesting Officer*

*Acting Commissioner of Patents and Trademarks*